US009886909B2

(12) United States Patent
An et al.

(10) Patent No.: US 9,886,909 B2
(45) Date of Patent: Feb. 6, 2018

(54) DISPLAY DEVICE AND METHOD FOR DRIVING DISPLAY DEVICE

(71) Applicant: SAMSUNG DISPLAY CO., LTD., Yongin, Gyeonggi-Do (KR)

(72) Inventors: Bo-Young An, Hwaseong-si (KR); Ji-Yun Son, Seongnam-si (KR); Ho-Suk Maeng, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 244 days.

(21) Appl. No.: 14/737,855

(22) Filed: Jun. 12, 2015

(65) Prior Publication Data

US 2016/0232852 A1 Aug. 11, 2016

(30) Foreign Application Priority Data

Feb. 6, 2015 (KR) ..... 10-2015-0018328

(51) Int. Cl.
*G09G 3/32* (2016.01)
*G09G 3/3291* (2016.01)
*G09G 3/20* (2006.01)

(52) U.S. Cl.
CPC ..... *G09G 3/3291* (2013.01); *G09G 3/20* (2013.01); *G09G 2310/0218* (2013.01); *G09G 2310/0221* (2013.01); *G09G 2320/0233* (2013.01); *G09G 2320/0626* (2013.01); *G09G 2330/021* (2013.01); *G09G 2360/16* (2013.01)

(58) Field of Classification Search
CPC .... G09G 3/3283; G09G 5/10; G09G 2360/04; G09G 2360/06
See application file for complete search history.

(56) References Cited

U.S. PATENT DOCUMENTS 8,957,844 B2 * 2/2015 Sim ..... F21V 7/22 345/102
2006/0087588 A1 * 4/2006 Cok ..... G09G 3/3216 348/556
2010/0085382 A1 * 4/2010 Lundqvist ..... G06F 1/1616 345/659

(Continued)

FOREIGN PATENT DOCUMENTS

KR 10-2011-0055259 A 5/2011
KR 10-2013-0055256 A 5/2013

(Continued)

*Primary Examiner* — Carolyn R Edwards
*Assistant Examiner* — Scott Au
(74) *Attorney, Agent, or Firm* — Lee & Morse, P.C.

(57) ABSTRACT

A display device includes a display panel including a first display area and a second display area, a primary driver integrated circuit (IC) to receive first input image of the first display area, to determine a luminance correction factor based on a sum of a first On-Pixel-Ratio (OPR) of the first display area and a second OPR of the second display area, to output a first image data signal to which the first input image data is remapped using the luminance correction factor, a secondary driver IC to receive second input image data of the second display area, to calculate the second OPR, to provide the second OPR to the primary driver IC, and to output a second image data signal to which the second input image data is remapped using the luminance correction factor, and a scan driver.

20 Claims, 9 Drawing Sheets

(56) References Cited

U.S. PATENT DOCUMENTS

2013/0002133 A1* 1/2013 Jin ..... H01L 51/524
313/511
2013/0342585 A1* 12/2013 Chun ..... G09G 3/3208
345/690

FOREIGN PATENT DOCUMENTS

KR 10-2013-0142748 A 12/2013
KR 10-2014-0076826 A 6/2014

* cited by examiner

DISPLAY DEVICE AND METHOD FOR DRIVING DISPLAY DEVICE

CROSS REFERENCE TO RELATED APPLICATION

Korean Patent Application No. 10-2015-0018328, filed on Feb. 6, 2015, in the Korean Intellectual Property Office, and entitled: "Display Device and Method For Driving Display Device," is incorporated by reference herein in its entirety.

BACKGROUND

1. Field

Example embodiments of the inventive concept relate to electronic system. More particularly, example embodiments of the inventive concept relate to display devices including a plurality of driver integrated circuits (driver ICs).

2. Description of the Related Art

A display device may include a plurality of driver ICs for providing data signals to a display panel. Each of the driver ICs controls an image display of a corresponding display area among a plurality of display areas in the display panel.

In the display device (e.g., an organic light emitting diode (OLED) display), a control method of automatically controlling current (Automatic Current Limit; ACL) to lower luminance on the display when the entire screen is lighted at high luminance by image data signals in one frame, is used to reduce power consumption. Each of the driver ICs performs the ACL operation for the corresponding display area.

SUMMARY

According to example embodiments, a display device may include a display panel including a first display area and a second display area each including a plurality of pixels, a primary driver integrated circuit (IC) to receive first input image data corresponding to an image of the first display area, to determine a luminance correction factor based on a sum of a first On-Pixel-Ratio (OPR) of the first display area and a second OPR of the second display area and to output a first image data signal to which the first input image data is remapped using a luminance correction factor, a secondary driver IC to receive second input image data corresponding to an image of the second display area, to calculate the second OPR, and to output a second image data signal to which the second input image data is remapped using the luminance correction factor, and a scan driver configured to provide a scan signal to the display panel.

In example embodiments, the primary driver IC may include a first auto current limiter configured to calculate a total OPR of a previous frame including total luminance information of the first and second display areas, and to remap the first input image data of a present frame based on the total OPR of the previous frame such that a luminance of the first display area is adjusted.

In example embodiments, the secondary driver IC may include a second auto current limiter configured to remap the second input image data of the present frame based on the total OPR of the previous frame such that a luminance of the second display area is adjusted.

In example embodiments, the first auto current limiter may include an OPR calculator configured to calculate the first OPR based on the first input image data, a communicator configured to receive the second OPR from the second auto current limiter and to provide the total OPR and the luminance correction factor to the second auto current limiter, a total OPR calculator configured to calculate the total OPR based on the sum of the first OPR and the second OPR, a luminance determiner configured to determine the luminance correction factor that commonly determines the luminance of the first and second display areas based on the total OPR, and a data compensator configured to remap the first input image data to the first image data signal by applying the luminance correction factor.

In example embodiments, the second auto current limiter may include an OPR calculator configured to calculate the second OPR based on the second input image data, a communicator configured to provide the second OPR to the first auto current limiter and to receive the luminance correction factor from the first auto current limiter, and a data compensator configured to remap the second input image data to the second image data signal by applying the luminance correction factor.

In example embodiments, the primary driver IC may provide a data voltage corresponding to the first image data signal to the first display area, and the secondary driver IC provides a data voltage corresponding to the second image data signal to the second display area.

In example embodiments, the primary driver IC and the secondary driver IC may include a timing controller and a data driver.

In example embodiments, the first display area may include a first main display area that is a flat display area and a first sub-display area that is a bent display area adjacent to the first main display area.

In example embodiments, the primary driver IC may independently calculate an OPR of the first main display area and an OPR of the first sub-display area.

In example embodiments, the primary driver IC may calculate at least one of the OPR of the first main display area and the OPR of the first sub-display area, and remap at least a part of the first input image data corresponding to at least one of the first main display area and the first sub-display area.

In example embodiments, the second display area may include a second main display area that is a flat display area and a second sub-display area that is a bent display area adjacent to the second main display area.

In example embodiments, the secondary driver IC may independently calculate an OPR of the second main display area and an OPR of the second sub-display area.

In example embodiments, the primary driver IC and the secondary driver IC may be synchronized by a vertical synchronizing signal such that the first image data signal from the primary driver IC and the second image data signal from the secondary IC are substantially simultaneously output.

In example embodiments, the secondary driver IC may include first to (j)-th secondary data driver ICs, where j is an integer greater than 1.

In example embodiments, the primary driver IC and the secondary driver IC may be formed on the display panel by a Chip On Glass (COG) type or a Chip On Film (COF) type.

According to example embodiments, a method for driving a display device including a primary driver integrated circuit (IC) and a secondary driver IC that have embedded timing controllers may include calculating, by the primary driver IC, a first On-Pixel-Ratio (OPR) of pixels included in a first display area of a display panel based on first input image data, calculating, by the secondary IC, a second OPR of pixels included in a second display area of the display panel based on second input image data, providing the second OPR, by the secondary driver IC, to the primary driver IC, determining, by the main driver IC, a luminance correction factor which determines luminance of the display panel based on a sum of the first OPR and the second OPR, providing the luminance correction factor, by the main driver IC, to the secondary driver IC, remapping, by the main driver IC, the first input image data to a first image data signal by applying the luminance correction factor, and remapping, by the secondary driver IC, the second input image data to a second image data signal by applying the luminance correction factor.

In example embodiments, remapping the first input image data to the first image data signal may further include providing a data voltage corresponding to the first image data signal to the first display area.

In example embodiments, remapping the second input image data to the second image data signal may further include providing a data voltage corresponding to the second image data signal to the second display area.

In example embodiments, the first display area may include a first main display area that is a flat display area and a first sub-display area that is a bent display area adjacent to the first main display area.

In example embodiments, the primary driver IC may independently calculate an OPR of the first main display area and an OPR of the first sub-display area.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
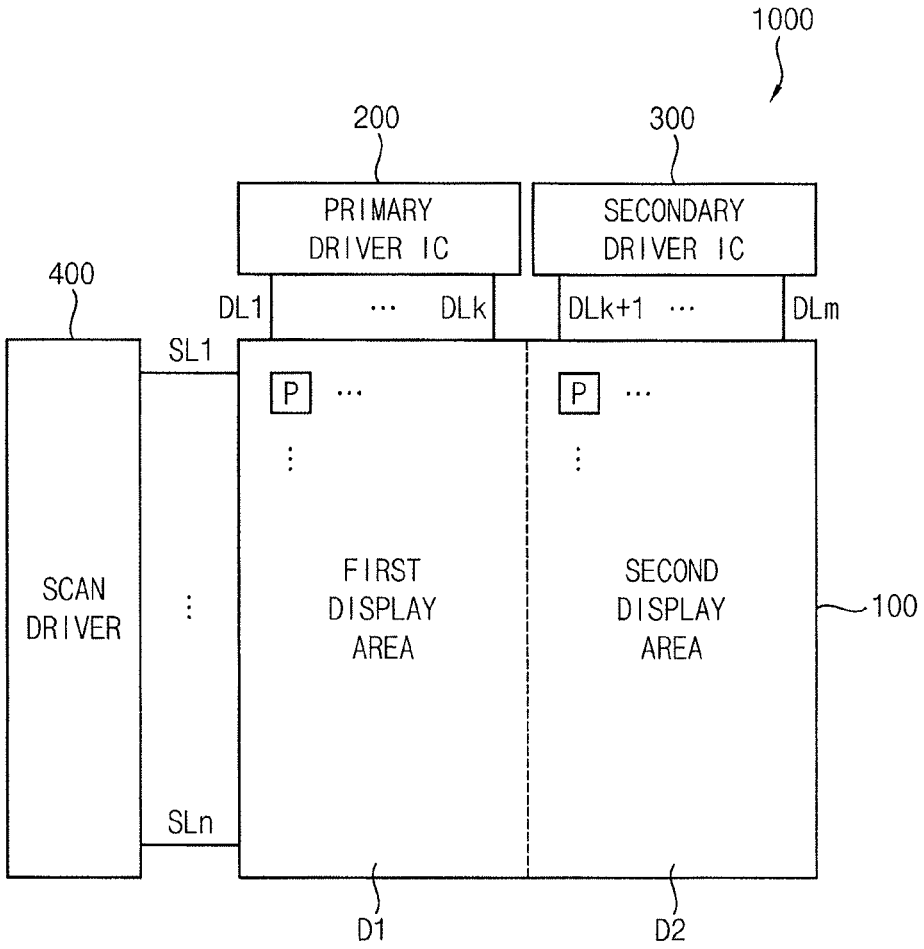
FIG. 1 illustrates a block diagram of a display device according to example embodiments.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

FIG. 1 illustrates a block diagram of a display device according to example embodiments.

Referring to FIG. 1, the display device 1000 includes a display panel 100, a primary driver integrated circuit (IC) 200, a secondary driver IC 300, and a scan driver 400. In some embodiments, the display device 1000 may include a plurality of driver ICs each having a timing controller and a data driver. Each driver IC may control an output image which is represented on a corresponding area of the display panel 100.

The display panel 100 may include a first display area D1 and a second display area D2, each having a plurality of pixels P. The display panel 100 may be connected to the scan driver 400 via a plurality of scan lines SL1 to SLn. The display panel 100 may be connected to the driver ICs 200 and 300 via a plurality of data lines DL1 to DLm. The display panel 100 may include M (M is a positive integer) pixel columns each connected to the respective data lines DL1 through DLm and N (N is a positive integer) pixel rows each connected to the respective scan lines SL1 through SLn. Thus, the pixels P can be arranged in a matrix form and the display panel 100 can include N*M pixels. In some embodiments, an image displayed on the first display area D1 may be controlled by the primary driver IC 200, and an image display on the second display area D2 may be controlled by the secondary driver IC 300. Since these are examples, the display panel 100 may include K display areas (K is an integer greater than 2) so that the display device 1000 can include one primary driver IC and (K−1) secondary driver ICs. In some embodiments, the display panel 100 may include at least one bent (or curved) display area.

In some embodiments, the primary driver IC 200 and the secondary driver IC 300 may include a timing controller and a data driver.

The primary driver IC 200 may receive first input image data corresponding to an image of the first display area D1, generate a first image data signal to which the first input image data is remapped, and provide a data voltage corresponding to the first image data signal to the first display area D1. In some embodiments, the primary driver IC 200 may determine a luminance correction factor, that determines luminance of the whole image displayed on the entire display area, based on a sum of a first On-Pixel-Ratio (OPR) of the pixels P included in the first display area D1 and a second OPR of the pixels P included in the second display area D2, and output the first image data signal to which the first input image data is remapped by using the luminance correction factor. The primary driver IC 200 may provide the luminance correction factor to the secondary driver IC 300. Thus, the luminance correction factor may be determined by the primary driver IC 200 based on the OPR of all pixels and may be commonly applied to an image data signal remapping operation of the primary and secondary driver ICs 200 and 300.

The OPR may be a ratio of the pixel number emitting predetermined grayscale light for the pixel number of the entire display panel 100. In some embodiments, the OPR may be expressed as a percentage. The OPR may correspond to a ratio of a sum of grayscales of the input image data for a sum of full white grayscales. For example, if the OPR is about 100%, the display panel 100 displays a white image, and, if the OPR is about 0%, the display panel 100 displays a black image. When the pixels P include red pixels, green pixels, and blue pixels, the primary driver IC 200 (and the secondary driver IC 300) may respectively calculate the OPR of the red pixels (or red image data), the OPR of the green pixels (or green image data), and the OPR of the blue pixels (or blue image data).

In some embodiments, the primary driver IC 200 may include a first auto current limiter configured to calculate a total OPR of a previous frame including total luminance information of the first and second display areas D1 and D2, and to remap the first input image data of a present frame based on the total OPR of the previous frame such that a luminance of the first display area is adjusted. The first auto current limiter will be described in detail with reference to FIGS. 2 and 3.

The secondary driver IC 300 may receive a second input image data corresponding to an image of the second display area D2, generate a second image data signal which is remapped data of the second input image data, and provide a data voltage corresponding to the second image data signal to the second display area D2. In some embodiments, the secondary driver IC 300 may calculate the second OPR, transmit the second OPR to the primary driver IC 200, receive the luminance correction factor from the primary driver IC 200, and output the second image data signal to which the second input image data is remapped using the luminance correction factor. The secondary driver IC 300 may not determine the luminance correction factor.

In some embodiments, the secondary driver IC 300 may include a second auto current limiter configured to remap the second input image data of the present frame based on the total OPR of the previous frame such that a luminance of the second display area is adjusted. The primary driver IC 200 and the secondary driver IC 300 may perform auto current limit (ACL) operation to adjust the luminance of the image displayed on the display panel 100.

In some embodiments, the primary driver IC 200 and the secondary driver IC 300 may be formed on the display panel by a Chip On Glass (COG) type or a Chip On Film (COF) type.

The scan driver 400 may provide a scan signal to the display panel 100 via a plurality of scan lines SL1 to SLn. In some embodiments, each of the scan lines SL1 to SLn may be connected to pixels P arranged in one of the pixel rows.

As described above, the display device including the plurality of driver ICs may commonly use the luminance correction factor, which is determined by the primary driver IC 200, for remapping the input image data so that the first and second display areas D1 and D2 may display images having substantially the same luminance. Thus, luminance uniformity (and output image uniformity) between the first and second display areas D1 and D2 can be improved.

Figure 2:
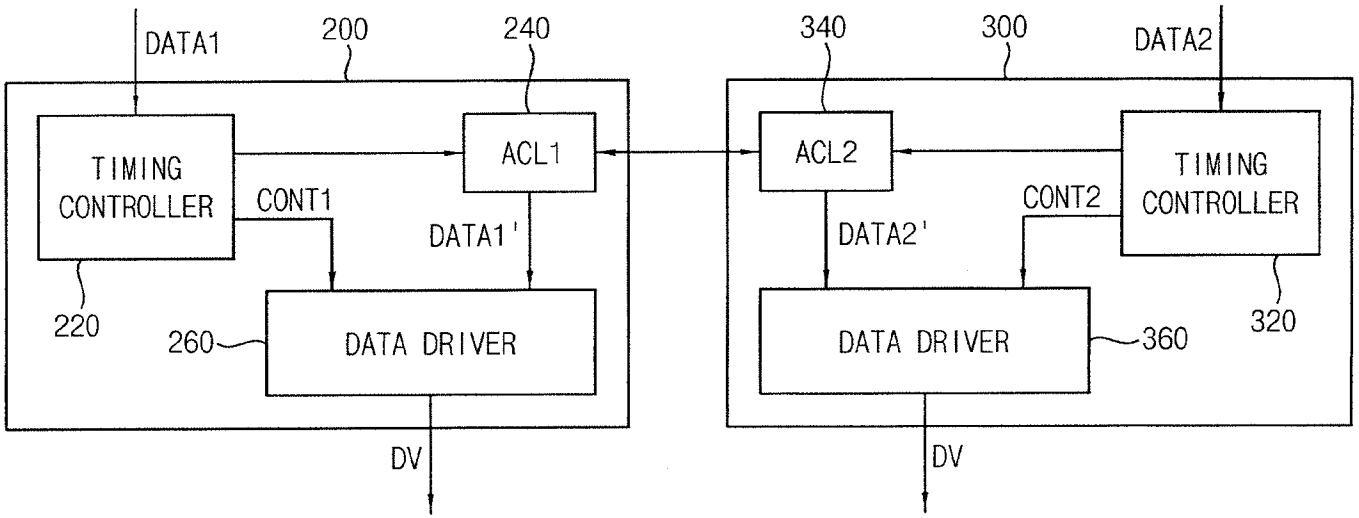
FIG. 2 illustrates a block diagram of an example of a primary driver IC and a secondary driver IC included in the display device of FIG. 1.

FIG. 2 illustrates a block diagram of an example of a primary driver IC and a secondary driver IC included in the display device of FIG. 1. Referring to FIGS. 1 and 2, the primary driver IC 200 includes a first timing controller 220, a first auto current limiter 240, and a first data driver 260, and the secondary driver 300 includes a second timing controller 320, a second auto current limiter 340, and a second data driver 360.

The first timing controller 220 in the primary driver IC 200 may generate a plurality of control signals CONT1 and provide the control signals CONT1 to the first auto current limiter 240, a scan driver 400, and the first data driver 260. The first timing controller 220 may control the scan driver 400 and the first data driver 260. The first timing controller 220 may receive an input control signal and a first input image data DATA1 from an image source such as an external graphic apparatus. The input control signal may include a main clock signal, a vertical synchronizing signal, a horizontal synchronizing signal, and a data enable signal. The first input image data DATA1 may correspond to an image represented on the first display area D1. The first timing controller 220 may generate an image data signal, e.g., a digital image data signal, and corresponds to operating conditions of the display panel 100 based on the first input image data DATA1. The first timing controller 220 may provide the image data signal to the first auto current limiter 240. In some embodiments, when the first auto current limiter 240 does not operate, the first timing controller 220 may provide the image data signal to the first data driver 260 directly.

The first auto current limiter 240 may calculate a total OPR of a previous frame including total luminance information of the first and second display areas D1 and D2, remap the first input image data DATA1 of a present frame to a first image data signal DATA1' based on the total OPR of the previous frame, such that a luminance of the first display area is adjusted. The first auto current limiter 240 may provide the first image data signal DATA1' to the first data driver 260. The first auto current limiter 240 performs the auto current limit operation such that the luminance of the first display area D1 can be adjusted. In some embodiments, the first auto current limiter 240 may remap the first input image data DATA1 to decrease the luminance of the first display area D1 when the luminance exceeds a predetermined reference luminance level. In some embodiments, the first auto current limiter 240 may be included in the first timing controller 220.

The first data driver 260 may provide a data voltage DV corresponding to the first image data signal DATA1' to the first display area D1. For example, when the luminance of the first display area D1 decreases, the data voltage DV decreases. Thus, the first auto current limiter 240 can decrease power consumption for driving the display panel 100.

The second timing controller 320 included in the secondary driver IC 300 may generate a plurality of control signals CONT2 and provide the control signals CONT2 to the scan driver 400 and the second data driver 360 such that the scan driver 400 and the second data driver 360 may be controlled. The second timing controller 320 may receive the input control signal and a second input image data DATA2 from the image source such as the external graphic apparatus. The input control signal may include a main clock signal, a vertical synchronizing signal, a horizontal synchronizing signal, and a data enable signal. The primary driver IC 200 and the secondary driver IC 300 may receive the same vertical synchronizing signal. In some embodiments, the primary driver IC 200 and the secondary driver IC 300 may be synchronized by the vertical synchronizing signal such that the first image data signal DATA1' and the second image data signal DATA2' are substantially simultaneously output. The second input image data DATA2 may correspond to an image represented on the second display area D2. In some embodiments, the second timing controller 320 may generate an image data signal which has a digital type and corresponds to operating conditions of the display panel 100 based on the second input image data DATA2. The second timing controller 320 may provide the image data signal to the second auto current limiter 340. In some embodiments, when the second auto current limiter 340 does not operate, the second timing controller 320 may provide the image data signal to the second data driver 360 directly.

The second auto current limiter 340 may remap the second input image data DATA2 of the present frame (e.g., the image data signal) based on the total OPR of the previous frame such that luminance of the second display area D2 is adjusted. The second auto current limiter 340 may provide the second image data signal DATA2' to the second data driver 360. The second current limiter 340 performs the auto current limit technique such that the luminance of the second display area D2 can be adjusted. In some embodiments, the second auto current limiter 340 may remap the second input image data DATA2 to decrease the luminance of the second display area when the luminance exceeds a predetermined reference luminance level. For example, the second auto current limiter 340 may generate the second image data signal DATA2' to decrease the luminance of the displayed image so that power consumption for driving the display panel 100 can be decrease. In some embodiments, the second auto current limiter 340 may be included in the second timing controller 320.

The second data driver 360 may provide a data voltage DV corresponding to the second image data signal DATA2' to the second display area D2.

Figure 3:
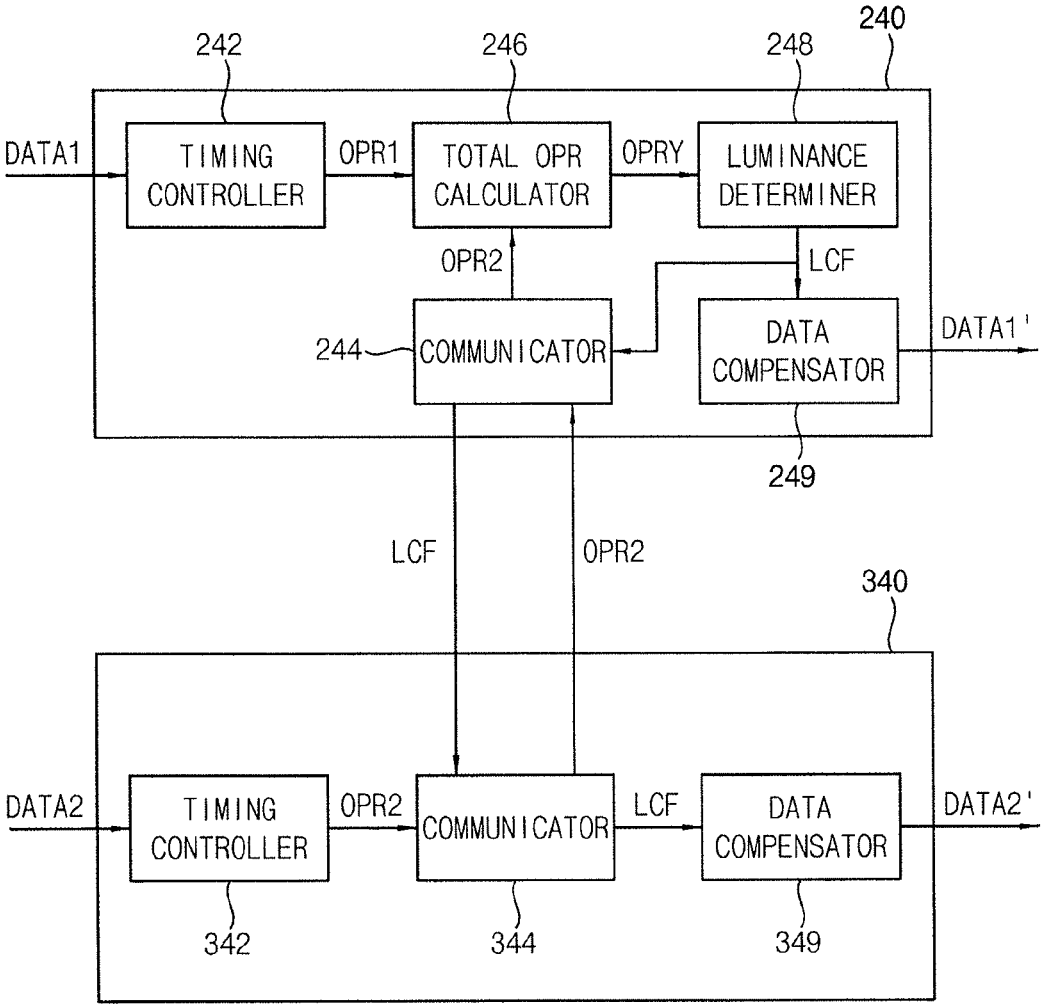
FIG. 3 illustrates a block diagram illustrating an example of first and second auto current limiters that are respectively included in the main and secondary driver ICs of FIG. 2.

FIG. 3 illustrates a block diagram of an example of first and second auto current limiters that are respectively included in the primary and secondary driver ICs of FIG. 2. Referring to FIGS. 1 to 3, the first auto current limiter 240 includes a first OPR calculator 242, a communicator 244, a total OPR calculator 246, a luminance determiner 248, and a data compensator 249. The second auto current limiter 340 includes a second OPR calculator 344, a communicator 344, and a data compensator 349.

The first OPR calculator 242 included in the first auto current limiter 240 may calculate the first OPR OPR1 based on the first input image data DATA1. The first OPR OPR1 may be OPR of the pixels of the first display area D1 in one frame. In some embodiments, the first OPR OPR1 may include OPR of red pixels, OPR of green pixels, and OPR of blue pixels. The first OPR calculator 242 may calculate the first OPR OPR1 referring to grayscale data included in the first input image data DATA1. The first OPR calculator 242 may provide the first OPR OPR1 to the total OPR calculator 246.

The communicator 244 may receive the second OPR OPR2 from the second auto current limiter 340 and provide the total OPR OPRY and the luminance correction factor LCF to the second auto current limiter 340. The second OPR OPR2 may be OPR of the pixels of the second display area D2 in one frame. The communicator 244 may communicate with the communicator 344 included in the second auto current limiter 340. The first auto current limiter 240 may calculate the total OPR OPRY by the communication, the first and second auto current limiters 240 and 340 may perform data remapping operation by commonly using the luminance correction factor LCF. In some embodiments, the communicators 244 and 344 may communicate using I2C communication method, SPI communication method, etc.

The total OPR calculator 246 may calculate the total OPR OPRY based on the sum of the first OPR OPR1 and the second OPR OPR2. The total OPR OPRY may correspond to OPR of the whole pixels included in the display panel 100. The total OPR calculator 246 may obtain luminance level of the entire image of the one frame according to the first and second input image data DATA1 and DATA2 (i.e., the luminance level of input image) using the total OPR OPRY. Here, when the luminance level of the input image data is greater than a predetermined reference luminance level, the first and second luminance determiners 248 and 348 may apply the same luminance correction factor LCF to the first and second input image data DATA1 and DATA2 so that luminance of output image that is displayed on the display panel 100 may decrease. The method of calculating the total OPR OPRY will be described in detail with reference to FIG. 5.

The luminance determiner 248 may determine the luminance correction factor LCF that commonly determines the luminance of the first and second display areas D1 and D2 based on the total OPR OPRY. For example, the luminance determiner 248 may determine the luminance correction factor LCF based on a ratio of the expressible luminance level of the display device 100 to the luminance level of the input image. In some embodiments, the luminance determiner 248 may include a lookup table having luminance correction factors LCF corresponding to each total OPR OPRY that includes luminance level information of the input image. The luminance determiner 248 may provide the luminance correction factor LCF to the communicator 244 and the data compensator 249. Thus, the luminance correction factor LCF may be used in the auto current limit drive of the secondary driver IC 340. Therefore, the whole image data signals may be corrected to substantially the same scale. The luminance correction factor LCF may be a scaling factor for decreasing the luminance level (or grayscale level) of the image data signal.

The data compensator 249 may remap the first input image data DATA1 to the first image data signal DATA1' by applying the luminance correction factor LCF. For example, if the luminance range is 256 grayscales, the data compensator 249 may change (or compensate) the image data signal output from the first timing controller 242 to the first image data signal DATA1' using the following Equation 1.

$$R' = R(1 - LCF/256)$$

$$G' = G(1 - LCF/256)$$

$$B' = B(1 - LCF/256) \qquad \text{Equation 1}$$

where R, G, and B are red, green, and blue image data signals that are input to the data compensator 249, R', G', and B' are compensated red, green, and blue image data signals that are output from the data compensator 249, and LCF is the luminance correction factor that is determined by the luminance determiner 248.

The first auto current limiter 240 may further include dither (not illustrated) for dithering the first image data signal DATA1'.

The primary driver IC 200 may display an image having corrected luminance based on the first image data signal DATA1'.

The second OPR calculator 342 may calculate the second OPR OPR2 based on the second input image data DATA2. The second OPR OPR2 may be OPR of the pixels of the second display area D2 in one frame. In some embodiments, the second OPR OPR2 may include OPR of red pixels, OPR of green pixels, and OPR of blue pixels. The second OPR calculator 342 may calculate the second OPR OPR2 referring to grayscale data included in the second input image data DATA2. The second OPR calculator 342 may provide the second OPR OPR2 to the communicator 344.

The communicator 344 may provide the second OPR OPR2 to the first auto current limiter 240 and receive the luminance correction factor LCF from the first auto current limiter 240. The communicator 344 may communicate with the communicator 244 included in the first auto current limiter 240. The communicator may provide the luminance correction factor LCF to the data compensator 349.

The data compensator 349 may remap the second input image data DATA2 to the second image data signal DATA2' by applying the luminance correction factor LCF. Thus, the first and second input image data DATA1 and DATA2 may be corrected to substantially the same scale due to the luminance correction factor LCF that is commonly applied to the first and second input image data DATA1 and DATA2.

The second auto current limiter 340 may further include a dither (not illustrated) for dithering the second image data signal DATA2'.

As described above, the display device 100 according to example embodiments includes the first primary driver IC 200 configured to determine a common luminance correction factor LCF based on the communication between the primary driver IC 200 and the secondary driver IC 300. Thus, image data signals for a frame may be remapped to have substantially the same luminance level. Therefore, luminance uniformity of the entire image of the frame can be improved.

Figure 4:
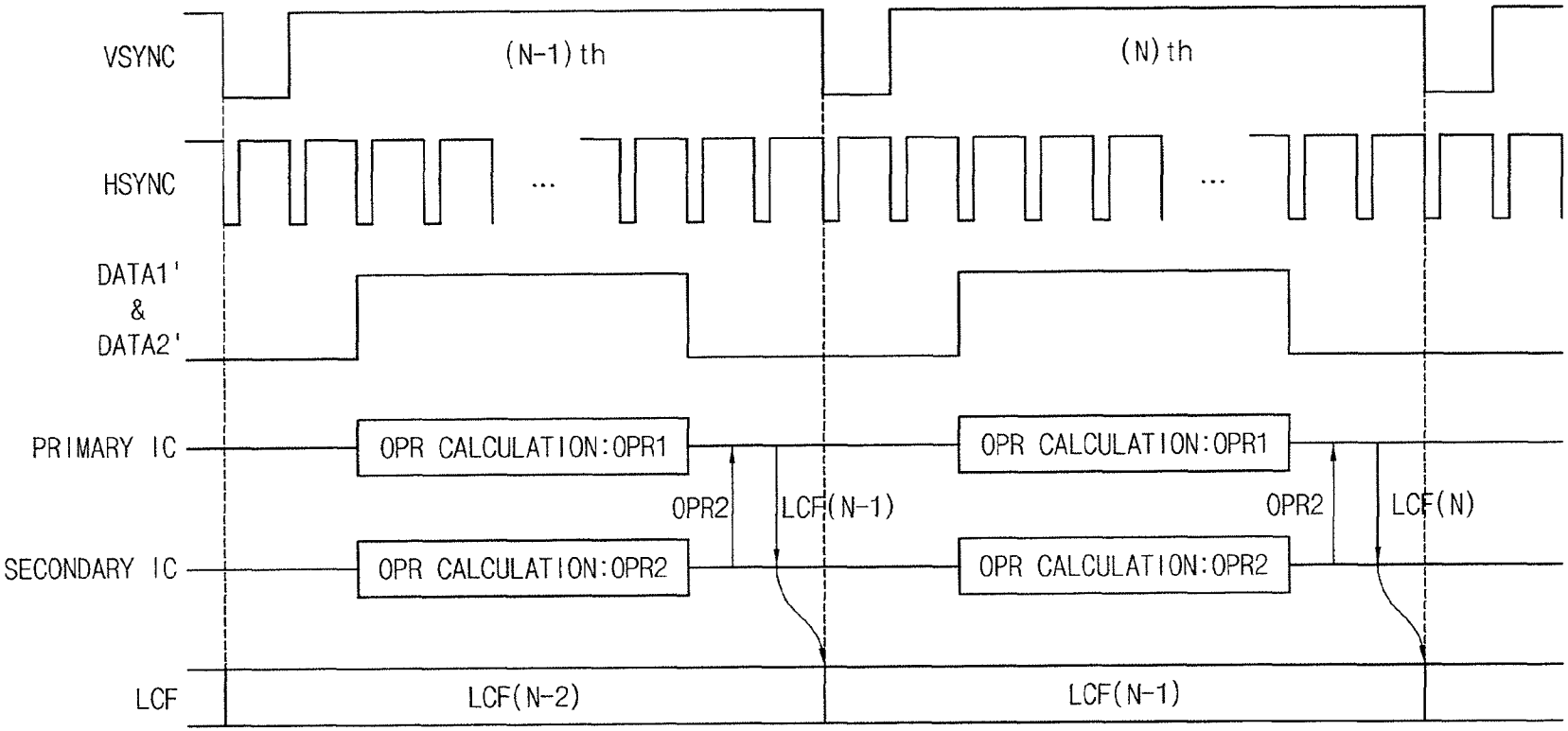
FIG. 4 illustrates a timing diagram of an example of an operation of the main and secondary driver ICs of FIG. 2.

FIG. 4 illustrates a timing diagram of an example of an operation of the primary and secondary driver ICs of FIG. 2. Referring to FIGS. 2 to 4, the primary driver IC 200 and the secondary driver IC 300 may output image data DATA that is compensated by the luminance correction factor LCF.

As illustrated in FIG. 4, in some embodiments, the primary driver IC 200 and the secondary driver IC 300 may substantially simultaneously receive a vertical synchronizing signal VSYNC and a horizontal synchronizing signal HSYNC. In some embodiments, the first and second auto current limiters 240 and 340 may be synchronized by the vertical synchronizing signal VSYNC such that the first image data signal DATA1' and the second image data signal DATA2' may be substantially simultaneously output.

The first and second image data signals DATA1' and DATA2' that are respectively output from the primary driver IC 200 and the secondary driver IC 300 during an (N−1)th frame are corrected data signals by the luminance correction factor LCF(N−2) that is calculated at an (N−2)th frame. In the (N−1)th frame, the primary driver IC 200 may calculate the first OPR OPR1 and the secondary driver IC 300 may calculate the second OPR OPR2. Then, the secondary driver IC 300 may provide the second OPR OPR2 to the primary driver IC 200. The primary driver IC 200 received the second OPR OPR2 may determine the luminance correction factor LCF(N−1) based on the sum of the first OPR OPR1 and the second OPR OPR2. The primary driver IC 200 may provide the luminance correction factor LCF(N−1) to the secondary driver IC 300.

In an (N)th frame, the primary driver IC 200 and the secondary driver IC 300 may be synchronized by the vertical synchronizing signal VSYNC. The primary driver IC 200 and the secondary driver IC 300 may respectively output the first and second image data signals DATA1' and DATA2' to which the luminance correction factor LCF(N−1) is applied. The display panel 100 may display an image based on the first and second image data signals DATA1' and DATA2'. The primary driver IC 200 may generate the luminance correction factor LCF(N−1) of the (N)th frame and remap the image data signal by applying the luminance correction factor LCF(N−1) to the image data signal of an (N+1)th frame.

As described above, the primary driver IC 200 and the secondary driver IC 300 may communicate with each other and may output (or generate) the corrected image data signals to which the common luminance correction factor LCF is applied.

Figure 5:
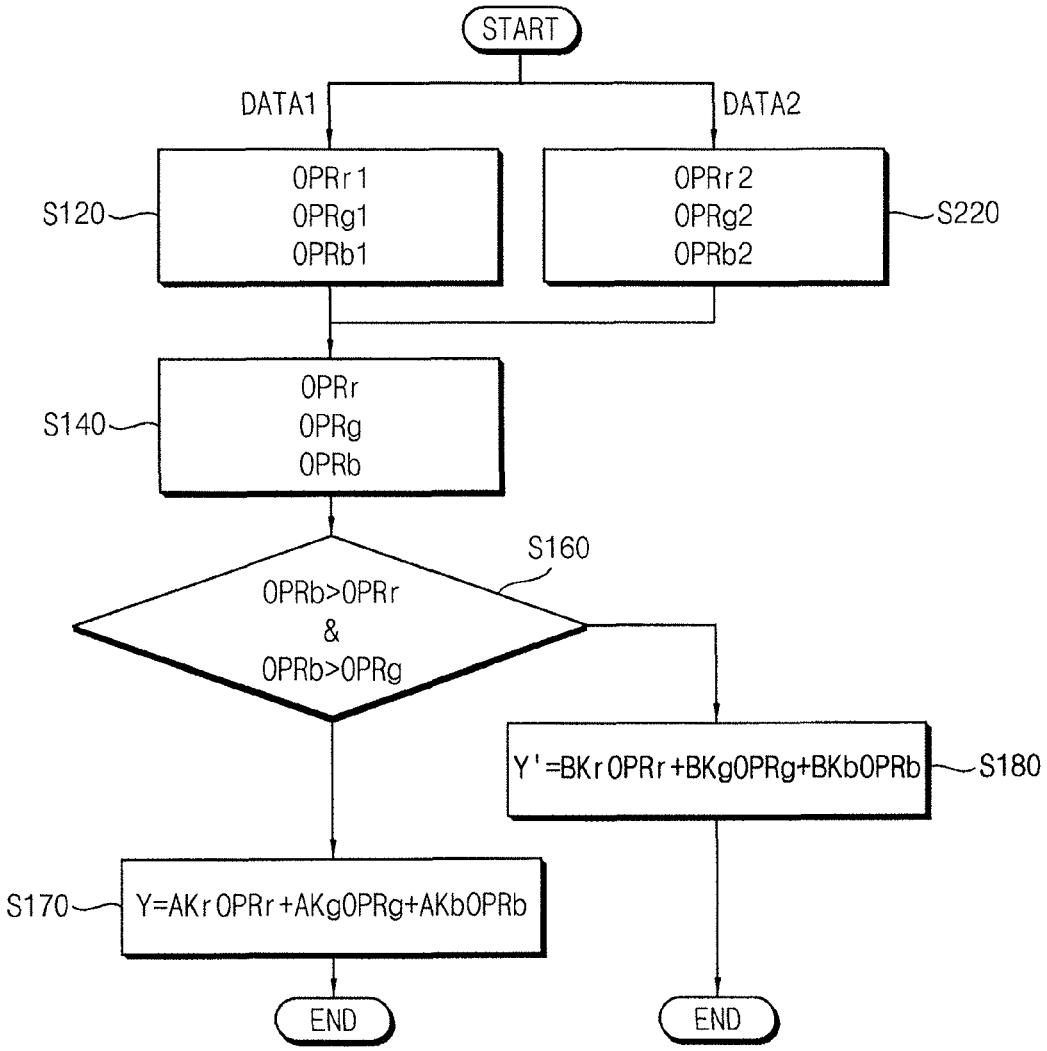
FIG. 5 illustrates a flow chart of an example of an operation of the primary driver IC which calculates total on-pixel ratio.

FIG. 5 illustrates a flow chart of an example of an operation of the primary driver IC which calculates total on-pixel ratio. Referring to FIGS. 2, 3, and 5, the primary driver IC 200 may calculate the total OPR Y and Y' based on the first OPR OPR1 and the second OPR OPR2.

The primary driver IC 200 may calculate the first OPR OPR1 based on the first input image data DATA1 (S120). The first OPR OPR1 may be OPR of the pixels included in the first display area D1. The primary driver IC may calculate a first red OPR OPRr1, a first green OPR OPRg1, and a first blue OPR OPRb1, when the pixels include red, green, and blue pixels.

The secondary driver IC 300 may calculate the second OPR OPR2 based on the second input image data DATA2 (S220). The secondary driver IC 300 may calculate a second red OPR OPRr2, a second green OPR OPRg2, and a second blue OPR OPRb2, when the pixels include red, green, and blue pixels.

The primary driver IC 200 may calculate the sum (i.e., OPRr, OPRg, and OPRb) of the first OPR OPR1 (e.g., OPRr1, OPRg1, and OPRb1) and the second OPR OPR2 (e.g., OPRr2, OPRg2, and OPRb2) (S140).

In some embodiments, the primary driver IC 200 may compare a blue OPR OPRb with red and green OPRs OPRr and OPRg (S160).

If the blue OPR OPRb is smaller than or equal to the red and green OPRs OPRr and OPRg, a luminance equation Y is used to calculate the total OPR OPRY (S170). If the blue OPR OPRb is larger than the red and green OPRs OPRr and OPRg, ae luminance equation Y' is used to calculate the total OPR OPRY (S180). The luminance equations are represented by the following Equation 2.

$$Y=AKrOPRr+AKgOPRg+AkbOPRb$$

$$Y'=BKrOPRr+BKgOPRg+BkbOPRb \qquad \text{Equation 2}$$

where AKr, AKg, AKb, BKr, BKg, and BKb are coefficients depending on organic light emitting diode (OLED) material characteristics.

The equation Y is an equation developed for compensating for ordinary luminance, and the luminance Y' is an equation developed for automatically limiting current depending on the material characteristics of OLED. The equation Y' increases dependence on the image data signal applied to the blue pixels compared with the equation Y. Since the Equations 2 is an example, method for correcting the luminance are not limited thereto.

The primary driver IC 200 may determine the luminance correction factor LCF based on the total OPR PORY. In some embodiments, the primary driver IC 200 may determine the luminance correction factor LCF via a lookup table.

Figure 6:
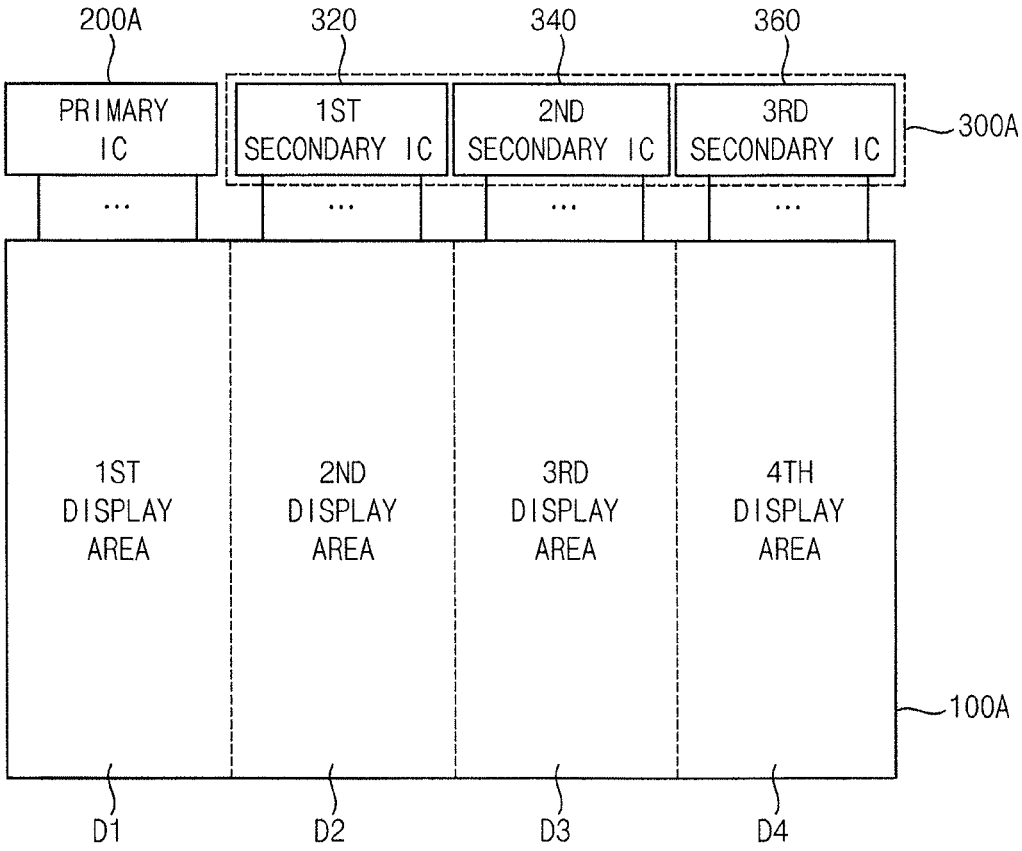
FIG. 6 illustrates a block diagram of an example of a secondary driver IC included in the display device of FIG. 1.

FIG. 6 illustrates a block diagram of an example of a secondary driver IC included in the display device of FIG. 1. Referring to FIGS. 1 and 6, the display device 100 may include a display panel 110A having a plurality of display areas, e.g., j display areas, a primary driver IC 200A, and a secondary driver IC 300A. In some embodiments, the secondary driver IC 300A may include first to (j)th secondary driver ICs.

In some embodiments, the display panel 100A may include first to fourth display areas D1, D2, D3, and D4. The first display area D1 may be connected to the primary driver IC 200A. First to third secondary driver ICs 320, 340, and 360 may be connected to the second to fourth display areas D2, D3, and D4, respectively.

The primary driver IC 200A may calculate an OPR of the first display area D1. The first to third secondary driver ICs 320, 340, and 360 may calculate OPRs of the second to fourth display areas D2, D3, and D4, respectively. The first to third secondary driver ICs 320, 340, and 360 may provide the calculated OPRs to the primary driver IC 200A.

The primary driver IC 200A may determine the luminance correction factor for determining the luminance of the whole display areas based on the OPRs of the first to fourth display areas D1, D2, D3, and D4. The primary driver IC 200A may provide the luminance correction factor to the first to third secondary driver ICs 320, 340, and 360.

The primary driver IC 200A and the first to third driver ICs 320, 340, and 360 may remap image data signals based on the luminance correction factor to decrease power consumption for driving the display panel 100, and may display an image on the display panel 100A based on the remapped image data signals.

Figure 7:
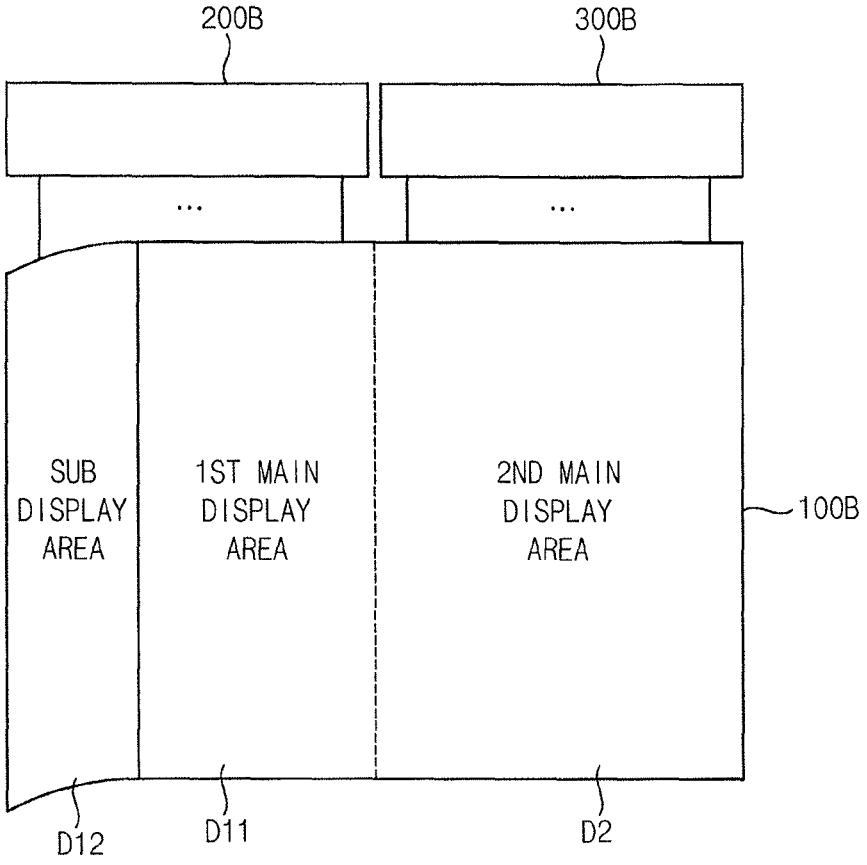
FIG. 7 illustrates a diagram of an example calculating on-pixel ratio according to a shape of a display panel included in the display device of FIG. 1.
Figure 8:
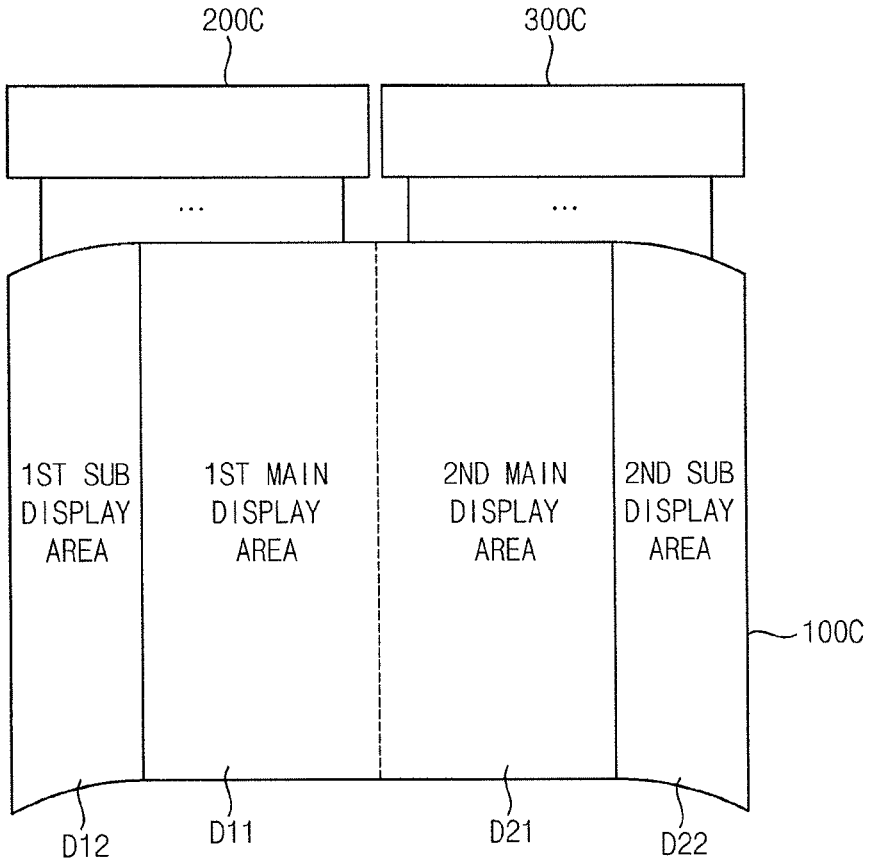
FIG. 8 illustrates a diagram of another example calculating on-pixel ratio according to a shape of a display panel included in the display device of FIG. 1.

FIG. 7 illustrates a diagram of an example calculating on-pixel ratio according to a shape of a display panel included in the display device of FIG. 1. FIG. 8 illustrates a diagram of another example calculating on-pixel ratio according to a shape of a display panel included in the display device of FIG. 1.

Referring to FIGS. 1, 7, and 8, the display device may include a display panel 100B and 100C having a plurality of display areas. The display areas may have various shapes.

The primary driver IC 200B and 200C may control an image displayed on the first display area D1. The secondary driver IC 200B and 200C may control an image displayed on the second display area D2.

In some embodiments, as illustrated in FIG. 7, the first display area D1 may include a first main display area D11 that is a flat display area and a first sub-display area D12 that is a bent display area adjacent to the first main display area D11. In some embodiments, the primary driver IC 200B may independently calculate an OPR of the first main display area D11 (hereinafter, represented to as 'OPRM1') and an OPR of the first sub-display area D12 (hereinafter, represented to as 'OPRS1'). In some embodiments, the primary driver IC 200B may calculate at least one of the OPRM1 and OPRS1, and may remap at least a part of the first input image data corresponding to at least one of the first main display area D11 and the first sub-display area D12. For example, when the first sub-display area D12 displays black image, the first sub-display area D12 may have very low luminance. Thus, the primary driver IC 200B does not need to perform the auto current limit operation at the first sub-display area D12. As a result, the primary driver IC 200B may only calculate the OPRM1, and calculate the luminance correction factor based on the OPRM1 and the second OPR that is received from the secondary driver IC 300B.

In some embodiments, the primary driver IC 200B may remap only the image data signals corresponding to the first main display area D11 based on the luminance correction factor. In some embodiments, the primary driver IC 200B may remap the image data signals corresponding to the first main display area D11 and the first sub-display area D12 based on the luminance correction factor. The secondary driver IC 300B may receive the luminance correction factor from the primary driver IC 200B and remap the image data signals corresponding to the second display area D2 based on the luminance correction factor.

As illustrated in FIG. 8, the second display area D2 may include a second main display area D21 that is a flat display area and a second sub-display area D22 that is a bent display area adjacent to the second main display area D21. In some embodiments, the secondary driver IC 300C may independently calculates an OPR of the second main display area D21 (hereinafter, represented to as 'OPRM2') and an OPR of the second sub-display area D22 (hereinafter, represented to as 'OPRS2').

For example, the primary driver IC 200C and the secondary driver IC 300C may calculate the OPRs of selected display areas according to a command. In some embodiments, when the first and second main display areas D11 and D12 display a black image (or be turned off), only the OPRS1 and OPRS2 (i.e., the OPRs of the first and second sub-display areas D12 and D22) are calculated. Here, the primary driver IC 200C and the secondary driver IC 300C may perform remapping image data corresponding to the first and second sub-display areas D12 and D22.

In some embodiments, the only OPRM1 and OPRM2 (i.e., the OPRs of the first and second main display areas D11 and D21) may be calculated. Here, the primary driver IC 200C and the secondary driver IC 300C may perform remapping image data corresponding to the first and second main display areas D11 and D21. On the other hand, the primary driver IC 200C and the secondary driver IC 300C may perform remapping image data the whole display areas D11, D12, D21, and D22.

As described above, the display device may calculate OPR corresponding to only portions of the display area required to luminance correction or remap partial image data corresponding to the portions. Thus, power consumption for remapping the image data can be decreased.

Figure 9:
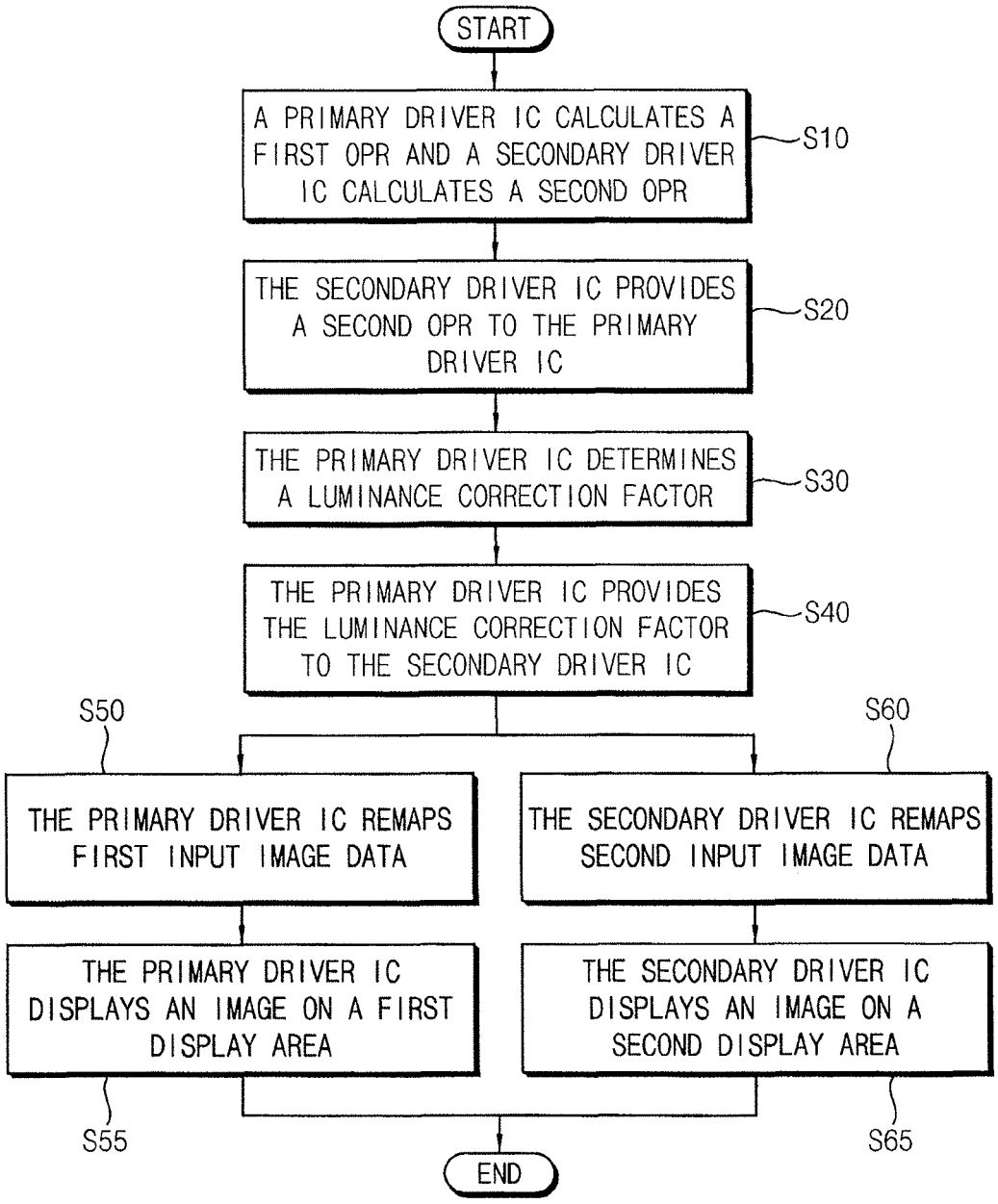
FIG. 9 illustrates a flow chart of a method for driving a display device according to example embodiments.

FIG. 9 illustrates a flow chart of a method for driving a display device according to example embodiments.

Referring to FIGS. 1 to 9, the method for driving the display device may include calculating a first OPR (S10), calculating a second OPR and providing the second OPR to a primary driver IC (S20), and determining a luminance correction factor based on the first OPR and the second OPR (S30). The primary driver IC may provide the luminance correction factor to a secondary driver IC (S40). Then, the primary driver IC may remap first input image data to a first image data signal (S50) by applying the luminance correction factor and provide a data voltage corresponding to the first image data signal to a first display area to display an image on the first display area (S55). The secondary driver IC may remap second input image data to a second image data signal (S60) by applying the luminance correction factor and provide a data voltage corresponding to the second image data signal to a second display area to display an image on the second display area (S65). The display device may include the primary and secondary driver ICs each having a timing controller (and a data driver).

In some embodiments, the first display area may include a first main display area that is a flat display area and a first sub-display area that is a bent display area adjacent to the first main display area. In this, the primary driver IC may independently calculate an OPR of the first main display area and an OPR of the first sub-display area. Similarly, the second display area may include a second main display area that is a flat display area and a second sub-display area that is a bent display area adjacent to the second main display area. In this, the primary driver IC may independently calculate an OPR of the second main display area and an OPR of the second sub-display area.

Since methods for driving the display device are described above referred to FIGS. 1 to 8, duplicate descriptions will not be repeated.

The present embodiments may be applied to any display device and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

By way of summation and review, as described above, the display device having a plurality of driver ICs for driving a plurality of display areas may determine the common luminance correction factor based on the communication between the primary driver IC and the secondary driver IC. Thus, image data signals for a frame may be remapped to have substantially the same luminance level. Thus, image data signals for a frame may be remapped to have substantially the same luminance level. Therefore, luminance uniformity of the entire image of the frame can be improved. Further, the display device may calculate OPR corresponding to only portions of the display area required to luminance correction or remap partial image data corresponding to the portions. Thus, power consumption for remapping the image data can be decreased.

In addition, the method for driving the display device including the plurality of driver ICs for driving a plurality of display areas may calculate total OPR of the entire display area based on the communication between the primary driver IC and the secondary driver IC, and perform the data remapping operation for decreasing the luminance of the output image based on the total OPR and the luminance correction factor that is generated in the primary driver IC and commonly applied to the primary driver IC and the secondary driver IC. Thus, output image uniformity may be improved.

In contrast, display areas that are separately controlled by respective corresponding driver ICs use different On-Pixel-Ratio (OPR) each corresponding to the respective display areas, so that the display areas may display images each having different luminance, decreasing output image uniformity.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device comprising:

a display panel including a first display area and a second display area, each including a plurality of pixels;

a primary driver integrated circuit (IC) to receive first input image data corresponding to an image of the first display area, to determine a luminance correction factor based on a sum of a first On-Pixel-Ratio (OPR) of the first display area and a second OPR of the second display area to output a first image data signal to which the first input image data is remapped using the luminance correction factor, the primary driver IC including a luminance determiner to determine the luminance correction factor that determines the luminance of the display panel in accordance with a total OPR based on a sum of the first OPR and the second OPR;

a secondary driver IC to receive second input image data corresponding to an image of the second display area and the luminance correction factor from the primary driver IC, to calculate the second OPR, to provide the second OPR to the primary driver IC, and to output a second image data signal to which the second input image data is remapped using the luminance correction factor; and a scan driver to provide a scan signal to the display panel.

2. The display device as claimed in claim 1, wherein the primary driver IC includes:

a first auto current limiter to calculate the total OPR of a previous frame including total luminance information of the first and second display areas, and to remap the first input image data of a present frame based on the total OPR of the previous frame such that a luminance of the first display area is adjusted.

3. The display device as claimed in claim 2, wherein the secondary driver IC includes:

a second auto current limiter to remap the second input image data of the present frame based on the total OPR of the previous frame such that a luminance of the second display area is adjusted.

4. The display device as claimed in claim 3, wherein the first auto current limiter includes:

an OPR calculator to calculate the first OPR based on the first input image data;

a communicator to receive the second OPR from the second auto current limiter and to provide the total OPR and the luminance correction factor to the second auto current limiter;

a total OPR calculator to calculate the total OPR; and a data compensator to remap the first input image data to the first image data signal by applying the luminance correction factor.

5. The display device as claimed in claim 3, wherein the second auto current limiter includes:

an OPR calculator to calculate the second OPR based on the second input image data;

a communicator to provide the second OPR to the first auto current limiter and to receive the luminance correction factor from the first auto current limiter; and a data compensator to remap the second input image data to the second image data signal by applying the luminance correction factor.

6. The display device as claimed in claim 1, wherein the primary driver IC is to provide a data voltage corresponding to the first image data signal to the first display area, and the secondary driver IC is to provide a data voltage corresponding to the second image data signal to the second display area.

7. The display device as claimed in claim 1, wherein the primary driver IC and the secondary driver IC each include a timing controller and a data driver.

8. The display device as claimed in claim 1, wherein the first display area includes a first main display area that is a flat display area and a first sub-display area that is a bent display area adjacent to the first main display area.

9. The display device as claimed in claim 8, wherein the primary driver IC is to independently calculate an OPR of the first main display area and an OPR of the first sub-display area.

10. The display device as claimed in claim 8, wherein the primary driver IC is to calculate at least one of the OPR of the first main display area and the OPR of the first sub-display area, and to remap at least a part of the first input image data corresponding to at least one of the first main display area and the first sub-display area.

11. The display device as claimed in claim 8, wherein the second display area includes a second main display area that is a flat display area and a second sub-display area that is a bent display area adjacent to the second main display area.

12. The display device as claimed in claim 11, wherein the secondary driver IC is to independently calculate an OPR of the second main display area and an OPR of the second sub-display area.

13. The display device as claimed in claim 1, wherein the primary driver IC and the secondary driver IC are to be synchronized by a vertical synchronizing signal such that the first image data signal from the primary driver IC and the second image data signal from the secondary IC are substantially simultaneously output.

14. The display device as claimed in claim 1, wherein the secondary driver IC includes first to (j)-th secondary data driver ICs, where j is an integer greater than 1.

15. The display device as claimed in claim 1, wherein the primary driver IC and the secondary driver IC are formed on the display panel by a Chip On Glass (COG) type or a Chip On Film (COF) type.

16. A method for driving a display device including a primary driver integrated circuit (IC) and a secondary driver IC that have embedded timing controllers, the method comprising:

calculating, by the primary driver IC, a first On-Pixel-Ratio (OPR) of pixels included in a first display area of a display panel based on first input image data;

calculating, by the secondary driver IC, a second OPR of pixels included in a second display area of the display panel based on second input image data;

providing the second OPR, by the secondary driver IC, to the primary driver IC;

determining, by the primary driver IC, a luminance correction factor which determines luminance of the display panel based on a sum of the first OPR and the second OPR;

providing the luminance correction factor, by the primary driver IC, to the secondary driver IC;

remapping, by the primary driver IC, the first input image data to a first image data signal by applying the luminance correction factor; and remapping, by the primary driver IC, the second input image data to a second image data signal by applying the luminance correction factor.

17. The method as claimed in claim 16, wherein remapping the first input image data to the first image data signal further includes:

providing a data voltage corresponding to the first image data signal to the first display area.

18. The method as claimed in claim 16, wherein remapping the second input image data to the second image data signal further includes:

providing a data voltage corresponding to the second image data signal to the second display area.

19. The method as claimed in claim 16, wherein the first display area includes a first main display area that is a flat display area and a first sub-display area that is a bent display area adjacent to the first main display area.

20. The method as claimed in claim 19, wherein calculating the first OPR includes independently calculating an OPR of the first main display area and an OPR of the first sub-display area.

* * * * *